US005898935A

United States Patent [19]

Davis

[11] Patent Number: 5,898,935

[45] Date of Patent: May 4, 1999

[54] CAP WITH ADJUSTABLE AND INTERCHANGEABLE VISOR ATTACHMENTS

[76] Inventor: Michael B. Davis, 7903 Orchard Wood Cir., Sacramento, Calif. 95828

[21] Appl. No.: 09/095,394

[22] Filed: Jun. 9, 1998

[51] Int. Cl.[6] ..... A42B 1/06

[52] U.S. Cl. ..... 2/10; 2/13; 2/195.1; 2/209.13; 351/155

[58] Field of Search ..... 2/10, 13, 195.1, 2/209.13; 351/155

[56] References Cited

U.S. PATENT DOCUMENTS

| | | |
|---|---|---|
| D. 340,796 | 11/1993 | Oates . |
| D. 349,389 | 8/1994 | Phillips . |
| D. 367,158 | 2/1996 | Baker . |
| 636,259 | 11/1899 | Hallin . |
| 1,677,187 | 7/1928 | Leibson . |
| 4,067,065 | 1/1978 | Slosek . |
| 5,012,528 | 5/1991 | Pernicka et al. . |
| 5,070,545 | 12/1991 | Tapia . |
| 5,253,364 | 10/1993 | Robinson . |
| 5,673,431 | 10/1997 | Batty ..... 2/10 |
| 5,687,420 | 11/1997 | Chong . |
| 5,689,827 | 11/1997 | Ryder . |

FOREIGN PATENT DOCUMENTS

| | | |
|---|---|---|
| 1 258 551 | 8/1989 | Canada . |
| 634093 | 2/1928 | France . |

*Primary Examiner*—Diana L. Biefeld
*Attorney, Agent, or Firm*—John P. O'Banion

[57] ABSTRACT

A cap with an adjustable visor section that is adjustable between a range from a lowered position, which gives the cap the appearance of a traditional baseball cap, and a raised position based on the incident sunlight and the wearer's preference, to shield the wearer's eyes. The visor section is removably attached to the sides of the cap thereby allowing other visors of different shapes or colors to be used interchangeably with the cap portion. The visor section also provides a means to attach protective eyewear thereon to further shield the wearer's eyes from sunlight or the like when the visor is worn in the lowered position.

15 Claims, 9 Drawing Sheets

CAP WITH ADJUSTABLE AND INTERCHANGEABLE VISOR ATTACHMENTS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

This invention relates generally to headwear, and more particularly to a cap having adjustable and interchangeable visors.

2. Description of the Background Art

It is well known that head-worn devices, such as baseball caps, are worn for two primary and distinct purposes, namely for protection from the sun's rays and also as a fashion accessory. Throughout the years, various features and functions have been incorporated into the traditional baseball-style cap to accommodate and/or enhance these two basic purposes, including variations and improvements to these features and functions.

One such feature is the adjustable visor, wherein the visor portion of the baseball cap is pivotally attached to the crown section of the baseball cap, thereby allowing the wearer to adjust the visor's angle relative to the incidence of the sun's rays to achieve an optimum balance between visibility and shielding. The adjustment capability also allowed the wearer to position the visor based on his or her aesthetic preferences and headroom clearance.

Another feature incorporated into the traditional baseball cap design is the capability of detaching and replacing the visor portion. This permitted the wearer to replace worn visors or to simply change visors to incorporated different colors, patterns and/or designs as desired. This aesthetically-based feature also allowed attachment of larger visors for greater sunlight protection.

Yet another feature seen in baseball-style caps is the capability to mount or attach sunglasses or tinted shades onto the cap. This is accomplished by a multitude of designs which attach the sunglasses or shades either onto the underside of the visor or to a forwardly disposed brim of the cap. The wearer can thereby attach his or her favorite sunglasses or shades to the cap to not only provide greater sunlight protection but also aesthetic flair. This feature is especially beneficial for use during physically intensive outdoor activities, such as tennis, volleyball or baseball, where there is a high probability for the sunglasses or shades falling off the wearer's face or the cap where it can be subsequently damaged or lost.

Presently, there are no known head-worn devices that incorporate all these features and functions into a single unitary baseball-style cap. Accordingly, there is a need for a cap that provides a means to securely attach sunglasses or sun shades thereon, and that also incorporates a visor capable of being pivotally adjusted and that is also removable and replaceable. The present invention satisfies these needs, as well as others, and generally overcomes the deficiencies found in the background art.

BRIEF SUMMARY OF THE INVENTION

The present invention is a hat, similar to a baseball cap, generally comprising a visor that is pivotally adjustable and detachable, and a means to mount protective eyewear, such as sunglasses or sunshades onto the visor. The visor is adjustable between a lowered position and a raised position. In the lowered position, the visor gives the cap an appearance generally resembling a traditional baseball cap. The visor can be raised from that position based on the incidence of sunlight on the wearer's eyes, headroom clearance, along with the wearer's individual preference and comfort, giving the cap a unique appearance. The means to mount protective eyewear is disposed beneath the visor and allow the protective eyewear to snap fit beneath the visor. With protective eyewear attached onto the visor and with the visor placed in its lowered position, the protective eyewear becomes positioned in front of the wearer's eyes, protecting the eyes from the sun's harmful rays. When sun shielding or protection is not required, the visor can be flipped to a raised position.

An object of the invention is to provide a cap having a visor adjustable from a lowered position to a raised position.

Another object of the invention is to provide a cap having a detachable visor.

Another object of the invention is to provide a cap onto which a multitude of visors having various shapes, colors or designs can be attached.

Still another object of the invention is to provide a cap having a visor onto which protective eyewear can be attached.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 9. It will be appreciated that the apparatus may vary as to configuration and as to details of the parts without departing from the basic concepts as disclosed herein.

Figure 1:
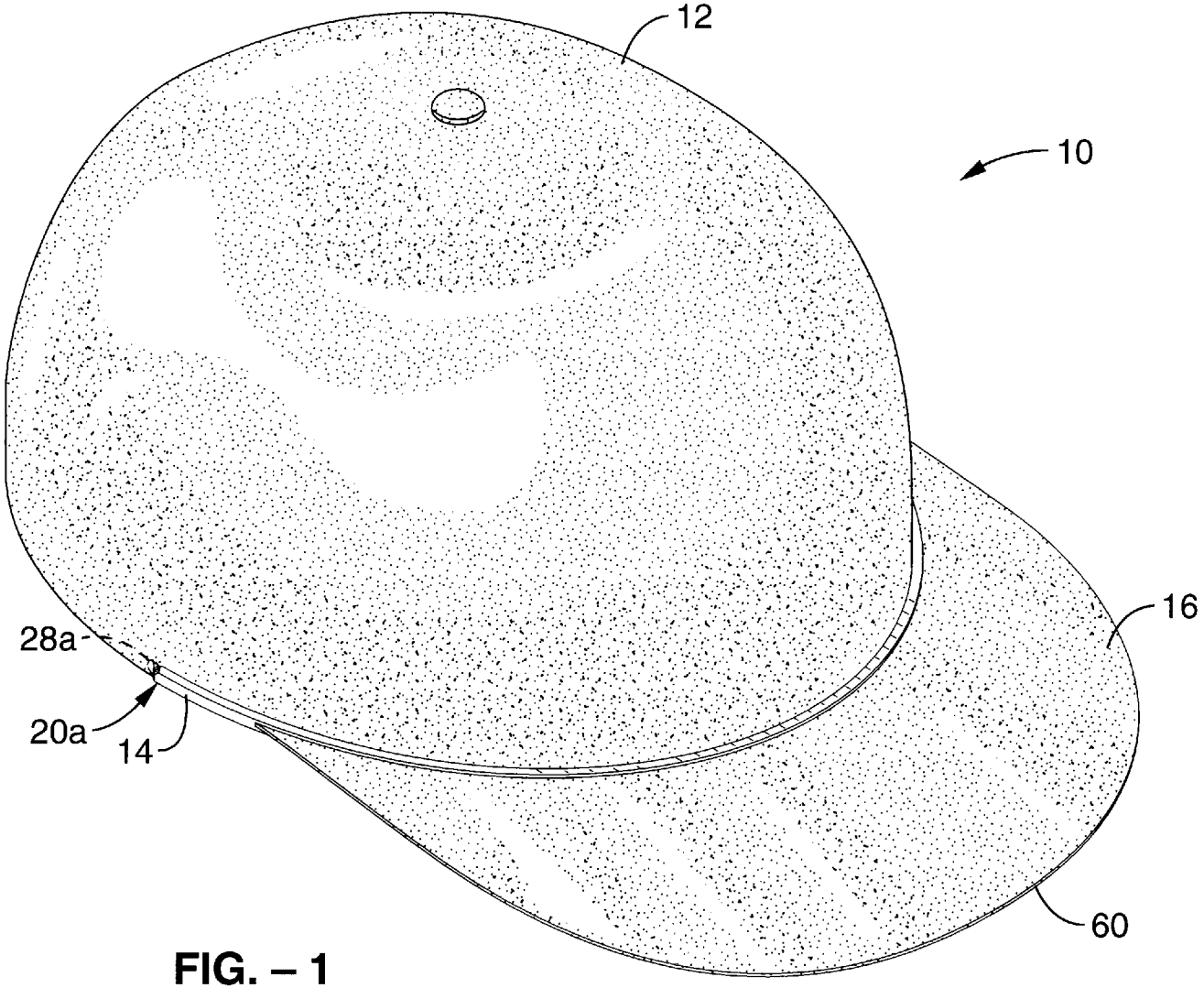
FIG. 1 is a perspective view of a cap apparatus of the present invention.
Figure 2:
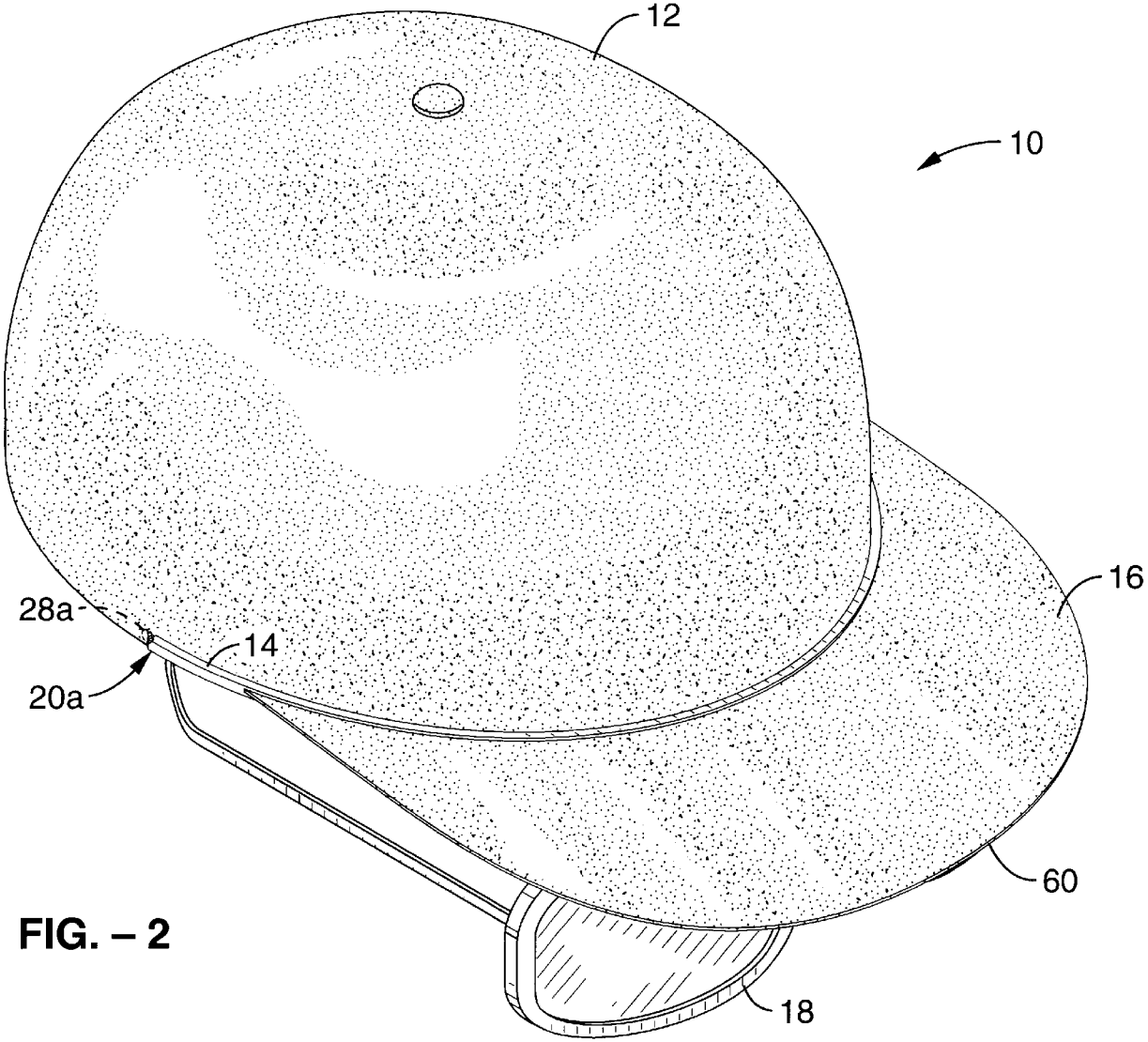
FIG. 2 is a perspective view of a cap apparatus of the present invention with protective eyewear attached thereon.
Figure 3:
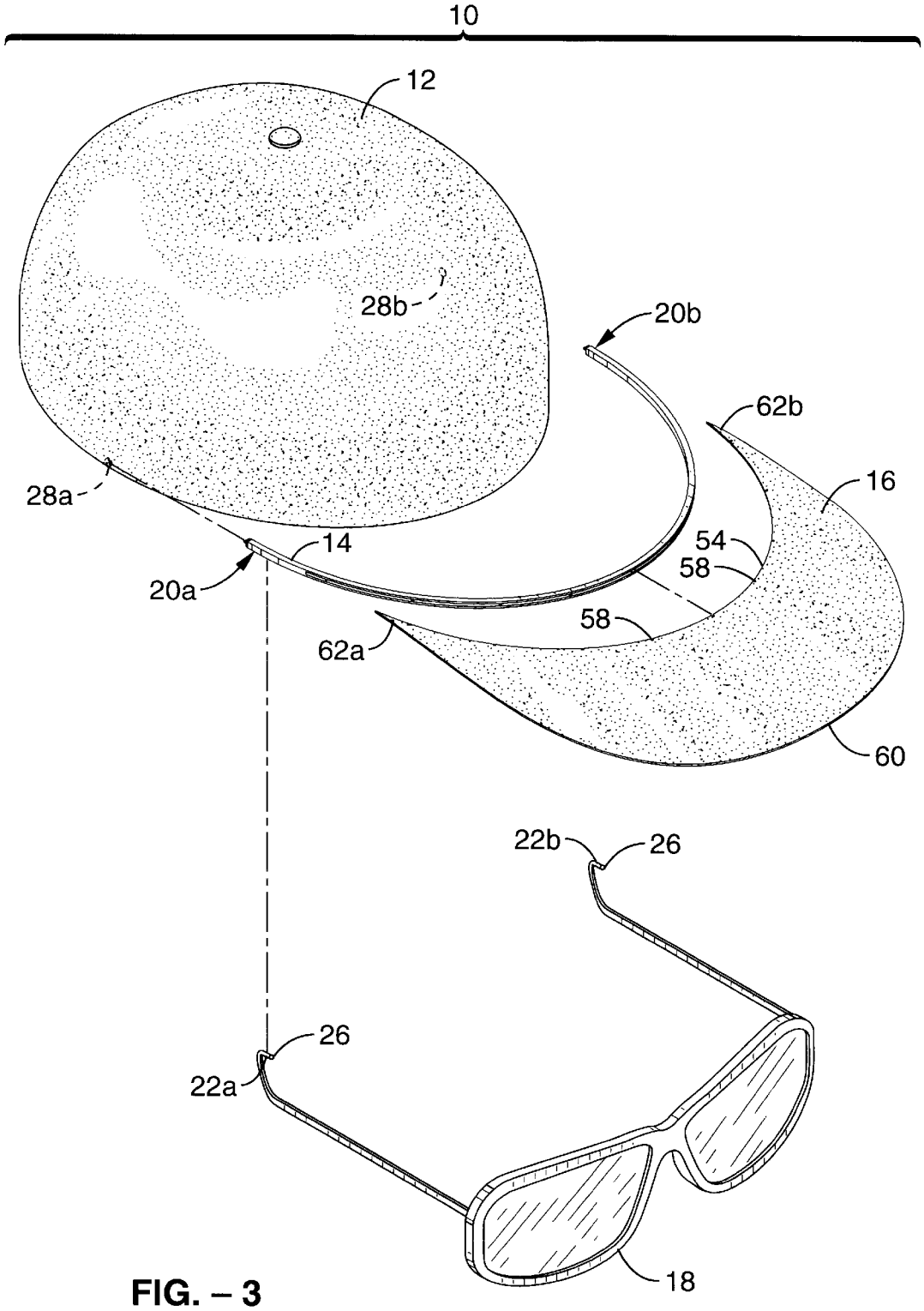
FIG. 3 is an exploded view of the cap apparatus shown in FIG. 2.

Referring first to FIG. 1 through FIG. 3, a visor cap apparatus 10 in accordance with the present invention is generally shown. Apparatus 10 generally comprises a crown portion 12, a visor support member 14 and a visor 16. In FIG. 2, a protective eyewear 18, such as sunglasses, is removably attached to visor support member 14 through temples 21*a,* 21*b* having curved, forwardly-disposed tips 22*a,* 22*b* as seen in FIG. 3. Crown portion 12 is generally semi-spherical to fit over the top of a wearer's head and is typically fabricated from a fabric or like material. Visor support member 14 is arcuate in shape and includes a pair of ends 20*a,* 20*b*.

Figure 4:
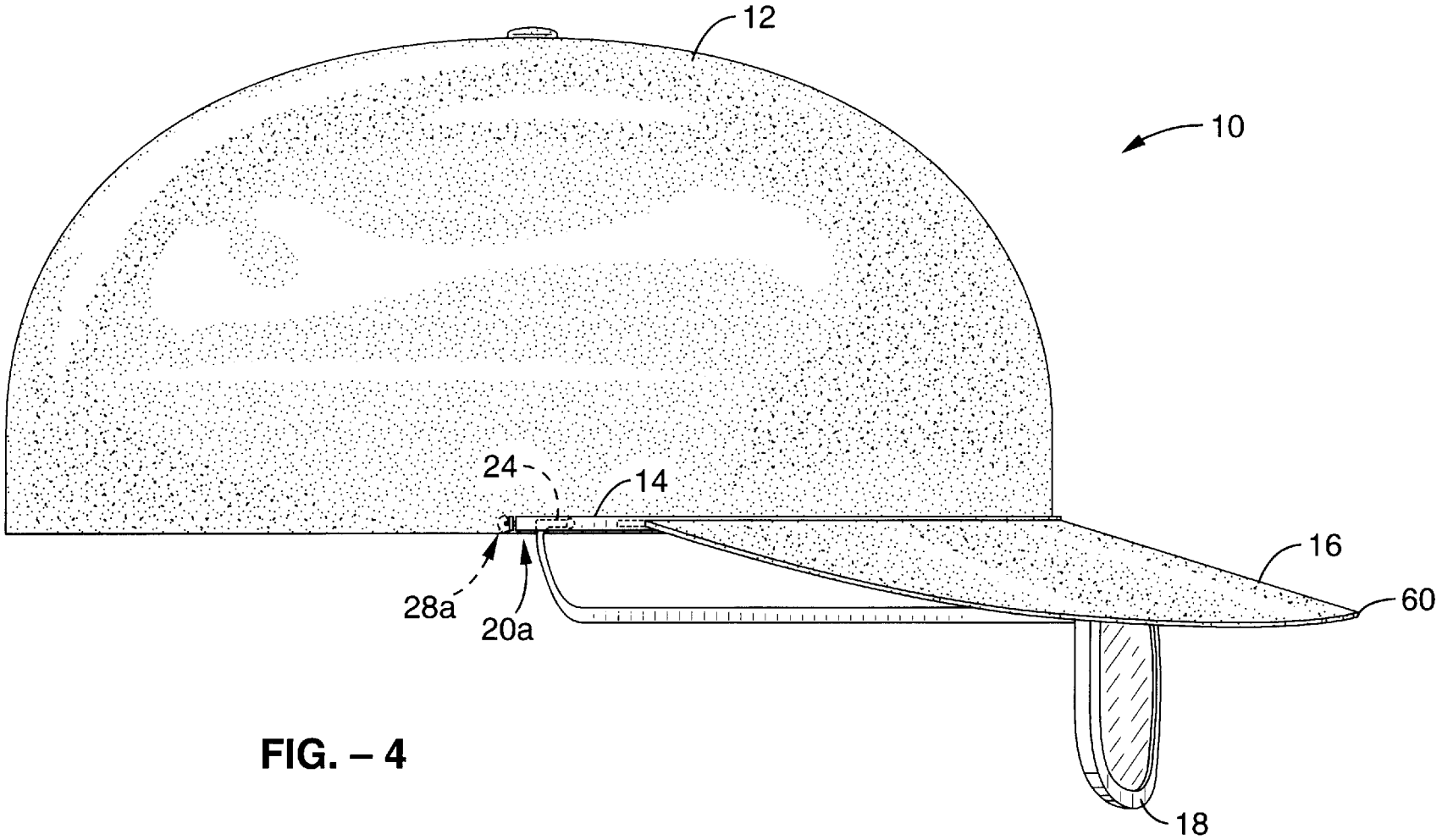
FIG. 4 is a side elevational view of the cap apparatus shown in FIG. 2.
Figure 5:
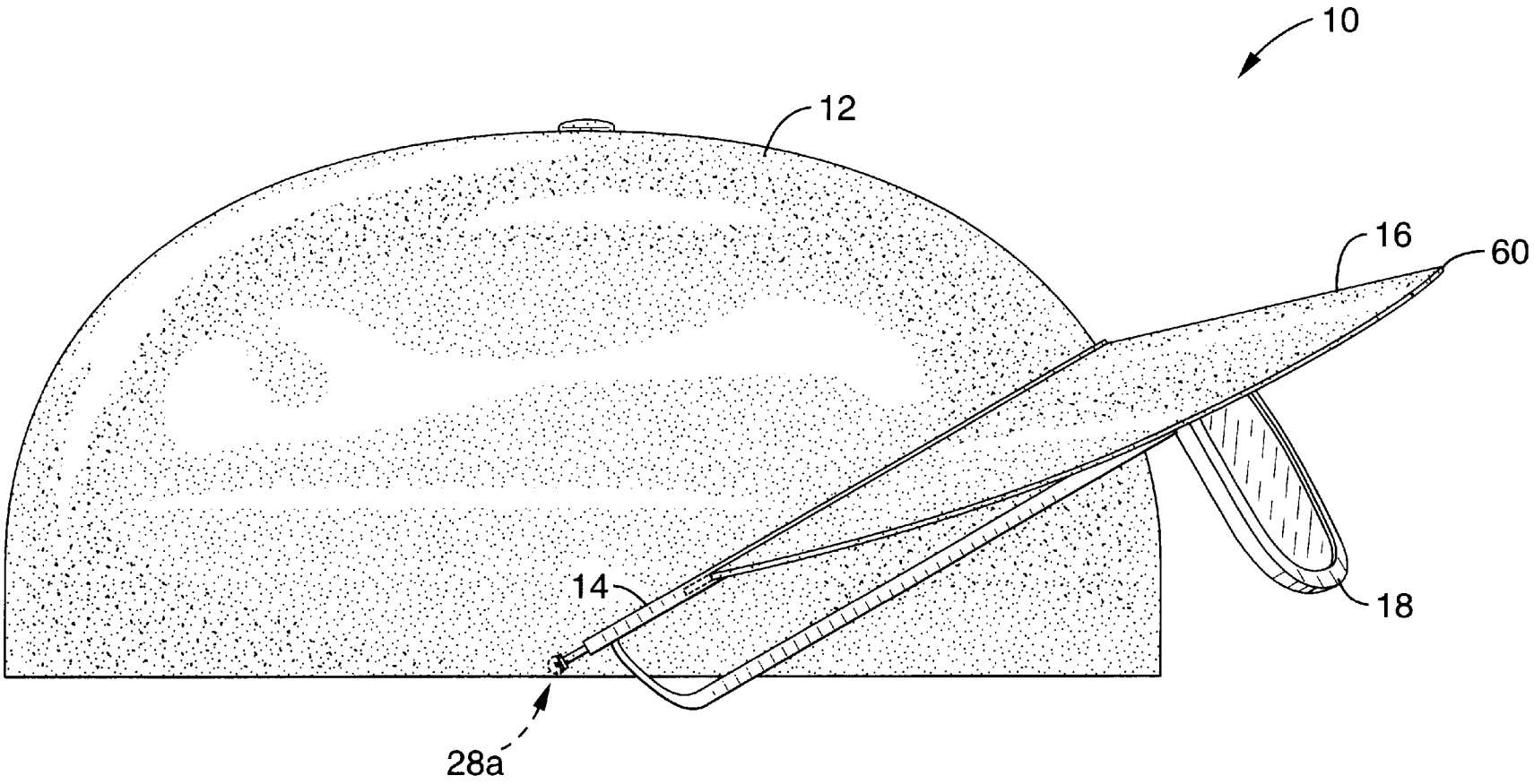
FIG. 5 is a side elevational view of the cap apparatus with the visor portion shown in a raised position.
Figure 6:
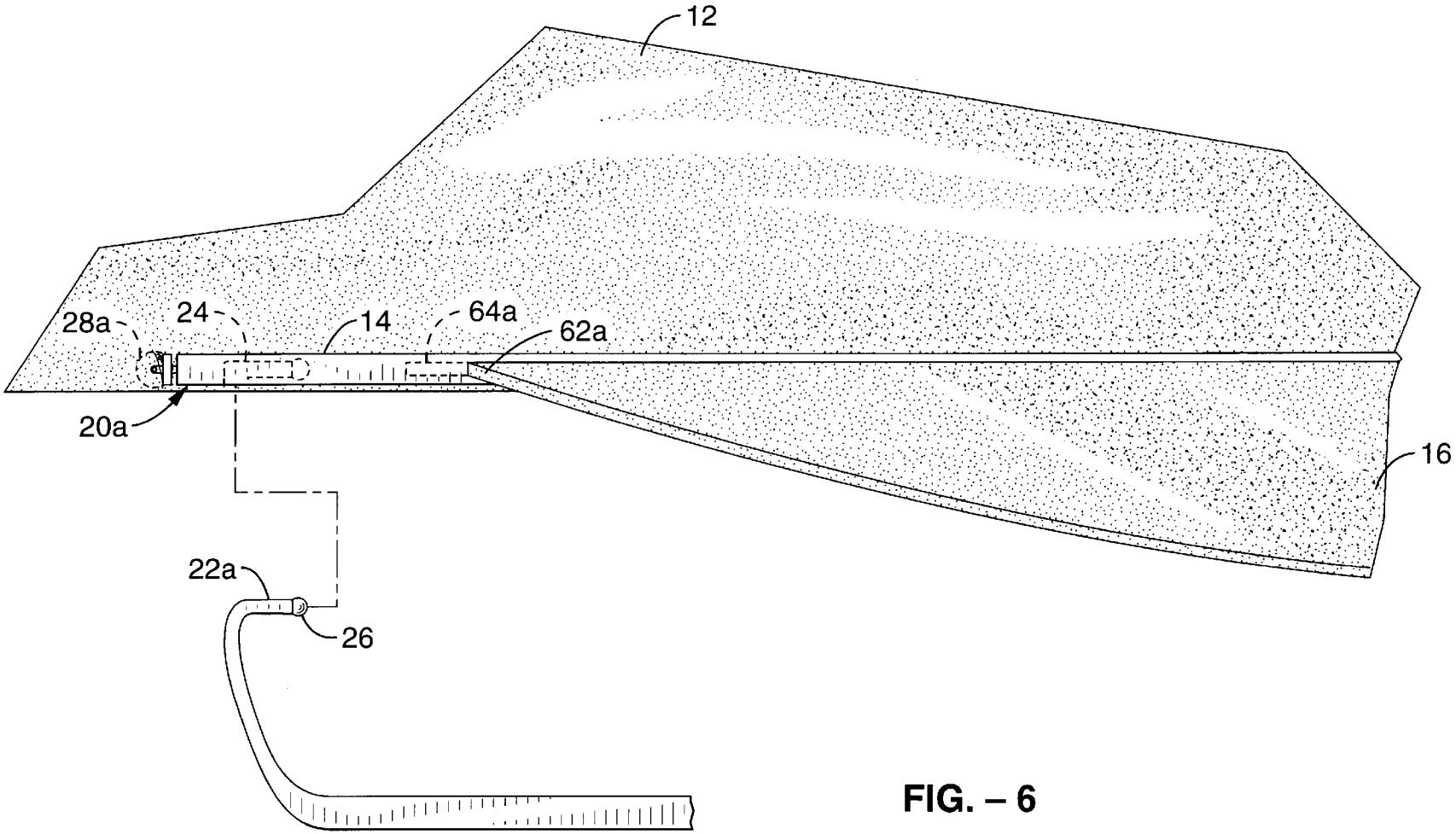
FIG. 6 is a detailed side elevational view of the sunglass attachment mechanism.

Referring also to FIG. 4 through FIG. 6, visor 16, along with protective eyewear 18, is adjustable between a lowered position as shown in FIG. 4 and a raised position as shown in FIG. 5. The adjustability of visor 16 is not dependent on whether protective eyewear 18 are attached thereon as those skilled in the art will appreciate that apparatus 10 can be used without protective eyewear 18. As can be seen in FIG. 6, for attachment of protective eyewear 18 onto apparatus 10, forwardly-disposed tip 22*a* is inserted into receptacle 24 disposed within visor support member 14 adjacent end 20*a*. Receptacle 24 is sized to tightly receive forwardly-disposed tip 22*a*. In order to better hold forwardly-disposed tip 22*a* within receptacle 24, and thus protective eyewear 18 against apparatus 10, forwardly-disposed tip 22*a* has a bulbous end 26. Forwardly-disposed tip 22*b* is similarly attachable to visor support member 14 through a receptacle (not shown) adjacent end 20*b* of visor support member 14.

Figure 7:
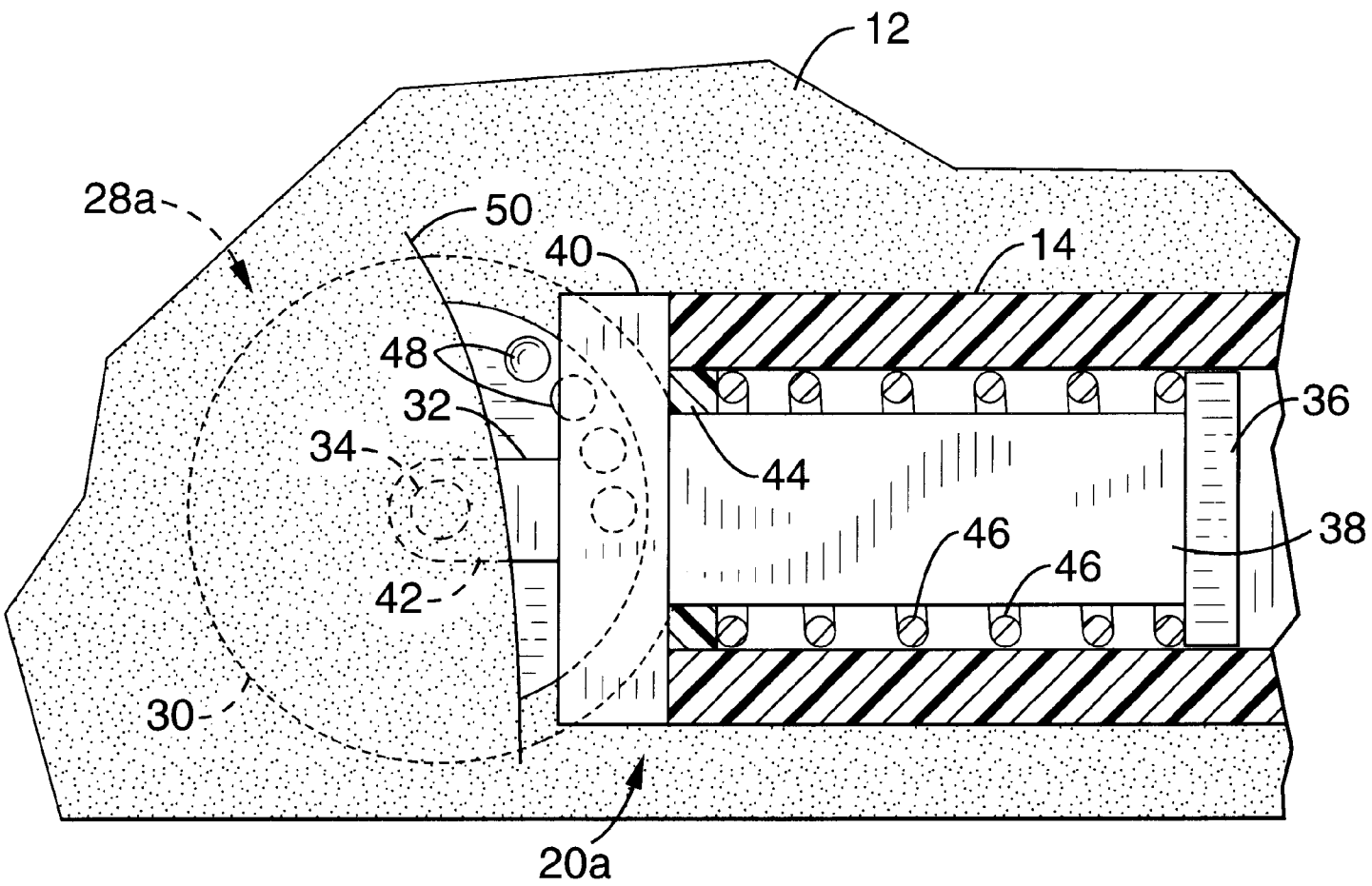
FIG. 7 is side elevational view of a swivel assembly taken along line 7—7 of FIG. 9.

Referring to FIG. 7, a swivel mechanism 28*a* allows for the adjustability of visor support member 14 to position visor 16 according to the wearer's needs. Swivel mechanism 28*a* is attached to the bottom right section of crown portion 12 and includes a disk or plate 30, a swivel arm 32 and means 34 for pivotally attaching swivel arm 32 to plate 30. For ease of manufacture and lower cost, pivotal attachment means 34 is preferably a headed pin or the like, although those skilled in the art will appreciate that pivotal attachment means 34 may comprise a more sophisticated assembly, such as miniature bearings.

Swivel arm 32 preferably has a rectangular profile extends longitudinally from pivotal attachment means 34 terminating with an outer spring stop 36, which is fixedly attached to the distal end 38 of swivel arm 32. A visor support member stop 40 is fixedly disposed on swivel arm 32 adjacent the proximate end 42 of swivel arm 32. An inner spring stop 44 is slidably positioned between outer spring stop 36 and visor support member stop 40. A spring 46 is disposed between outer spring stop 36 and inner spring stop 44 and rests on both respective components. Since outer spring stop 36 is fixed and inner spring stop 44 is slidable, spring 46 biases inner spring stop 44 towards proximate end 42 of swivel arm 32. Travel of inner spring stop 44 is limited by visor support member stop 40. End 20*a* of visor support member 14 is permanently attached to inner spring stop 44 so that biasing movements of inner spring stop 44 is translated to visor support member 14, thus maintaining visor support member 14 flush against crown portion 12 at all points within the adjustable range of visor support member 14. Although not depicted in such detail, end 20*b* of visor support member 14 is attached to swivel mechanism 28*b* located on the left side of crown portion 12 and functions, in all other aspects, identically.

A plurality of dish-shaped recesses 48 are positioned sequentially along an arc on plate 30. Recesses 48 serve as stops or detents to hold swivel arm 32 in a desired position along the adjustment range of visor support member 14. A boss (not shown) projecting from the underside of visor member stop 40 on swivel arm 32 frictionally and sequentially engages recesses 48 as visor support member 14 is moved between the lowered position and the raised position.

Plate 30 is preferably fabricated from either plastic or stamped metal and is sewn, riveted or glued onto the inner surface of crown portion 12. An arced slot 50 cut through crown portion 12 allows swivel arm 32 to extend outward therethrough. To make swivel mechanism 28*a,* 28*b* less conspicuous, plate 30 can be similarly attached to the sweatband (not shown), which are commonly found in caps.

Figure 8:
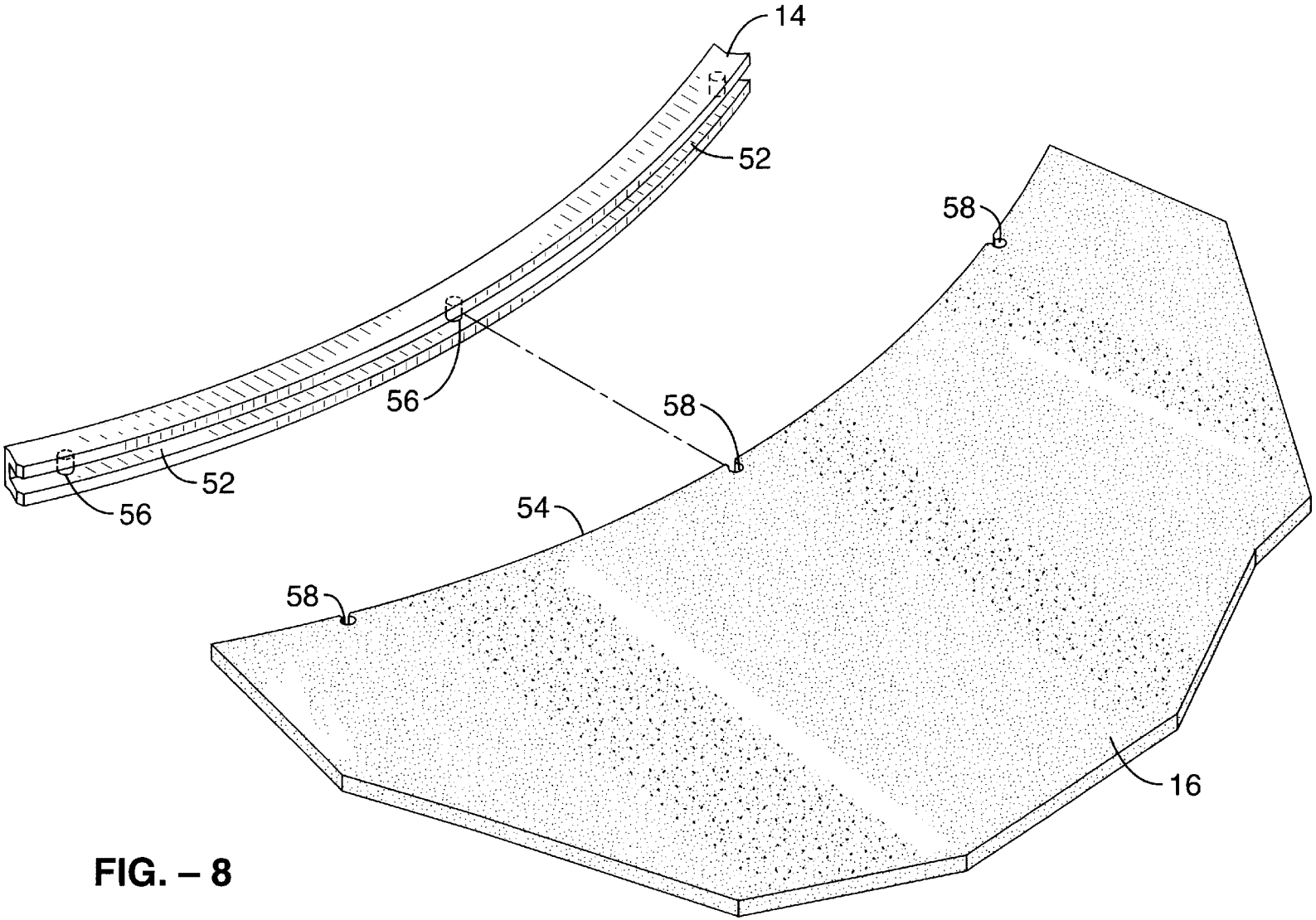
FIG. 8 is a exploded fragmentary view of the visor and visor support member.
Figure 9:
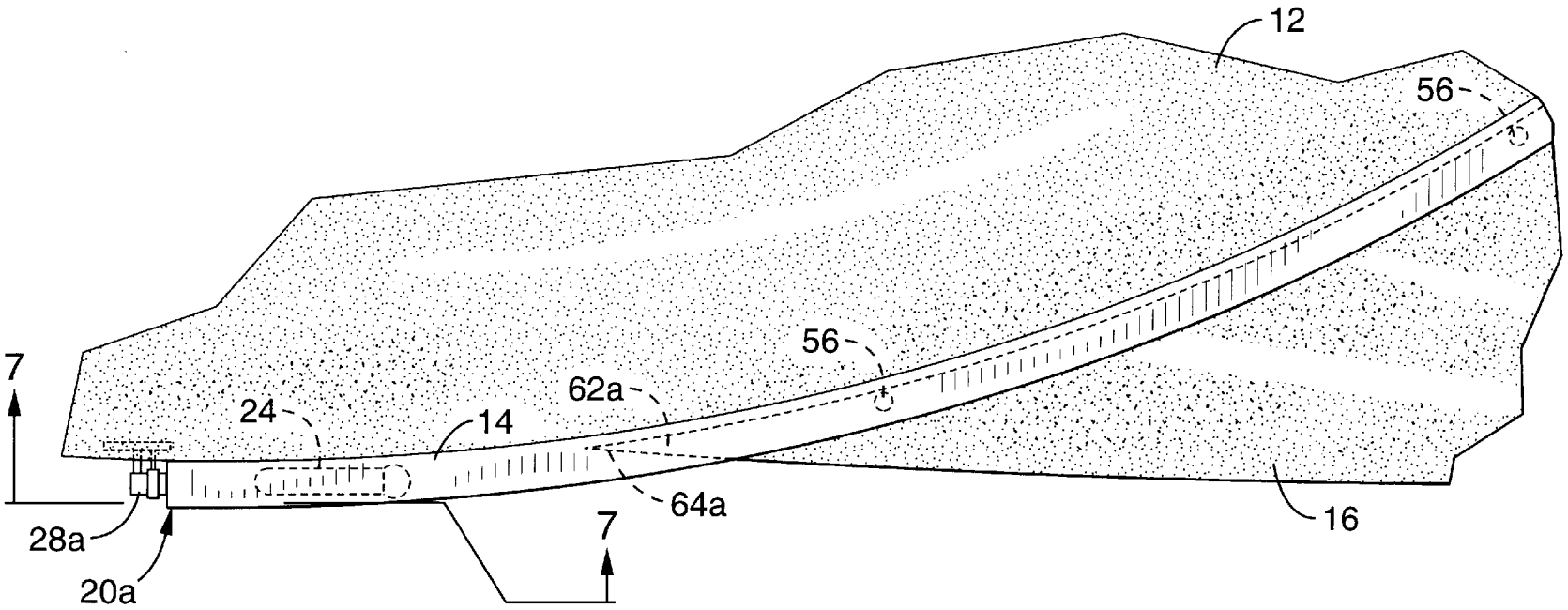
FIG. 9 is a top plan view of the swivel assembly and visor support member shown in FIG. 6.

Referring also to FIG. 8 and FIG. 9, it can be seen that visor 16 is detachable from visor support member 14. This detachable function allows for the replacement of visor 16 as desired with another having different colors and/or designs. Visor support member 14 is generally arcuate to conform to the shape of crown portion 12 and has a channel-like cross-section. Channel 52 is structured and configured to receive the arcuate trailing edge 54 of visor 16. A plurality of posts 56 are disposed transversely across channel 52. When visor support member 14 is attached to swivel mechanisms 28*a,* 28*b* as previously described, posts 56 are vertically disposed. Circular cutouts 58 on trailing edge 54 of visor 16 are positioned and configured to frictionally engage and lock onto posts 56. In order for trailing edge 54 of visor 16 to properly engage channel 52 of visor support member 14, trailing edge 54 is generally flat. Visor 16, however, is curved downwards from trailing edge 54 to leading edge 60, thus forming the commonly recognized shape of a cap visor. In order to maintain tip 62*a* of visor 16 from dangling, tip 62*a* is wedged into a pie-shaped ledge 64*a* located adjacent end 20*a* in visor support member 14, as can be seen in FIG. 8. Similarly, tip 62*b* of visor 16 wedged into a pie-shaped ledge (not shown) located adjacent end 20*b* in visor support member 14.

Accordingly, it will be seen that this invention provides a combination cap and detachably mounted protective eyewear, whereby the visor portion is removable and replaceable and is adjustable between a lowered position and a raised. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A cap, comprising:

(a) a crown portion;

(b) a visor support member;

(c) means for pivotally attaching said visor support member to said crown portion, wherein said visor support member is adjustable between a lowered position and a raised position;

(d) a visor removably attached to said visor support member; and (e) means for detachably mounting protective eyewear onto said visor support member.

2. An apparatus as recited in claim 1, wherein said visor support member comprises:

(a) an arcuate member, said arcuate member including a pair of ends; and (b) a channel, said channel extending between said ends of said arcuate member.

3. An apparatus as recited in claim 2, further comprising:

(a) a plurality of posts, said posts disposed within said channel of said arcuate member;

(b) a trailing edge on said visor, said trailing edge structured and configured to engage within said channel of said arcuate member; and (c) a plurality of cutouts, said cutouts disposed on said trailing edge of said visor, said cutouts structured and configured to frictionally engage said posts within said channel.

4. An apparatus as recited in claim 1, wherein said pivotal attachment means comprises:

(a) a plate, said plate attached to said crown portion; and (b) a swivel arm pivotally attached to said plate, said swivel arm structured and configured to receive said visor support member, said swivel arm including a proximal end.

5. An apparatus as recited in claim 4, further comprising:

(a) a plurality of recesses, said recesses disposed on said plate;

(b) a boss protruding from said swivel arm, said boss structured and configured to frictionally engage said recesses upon pivotal motion of said swivel arm; and (c) spring means for biasing said visor support member towards said proximal end of said swivel arm.

6. An apparatus as recited in claim 1, wherein said protective eyewear mounting means comprises a receptacle within said visor support member for receiving said protective eyewear.

7. A cap, comprising:

(a) a crown portion;

(b) an arcuate member pivotally coupled to said crown portion, said arcuate member adjustable between a lowered position and a raised position, said arcuate member including a pair of ends;

(c) a channel, said channel extending between said ends of said arcuate member;

(d) a visor removably attached to said arcuate member; and (e) means for detachably mounting protective eyewear onto said arcuate member.

8. An apparatus as recited in claim 7, further comprising:

(a) a plurality of posts, said posts disposed within said channel of said arcuate member;

(b) a trailing edge on said visor, said trailing edge structured and configured to engage within said channel of said arcuate member; and (c) a plurality of cutouts, said cutouts disposed on said trailing edge of said visor, said cutouts structured and configured to frictionally engage said posts within said channel.

9. An apparatus as recited in claim 7, further comprising:

(a) a plate, said plate attached to said crown portion; and (b) a swivel arm pivotally attached to said plate, said swivel arm structured and configured to receive said arcuate member, said swivel arm including a proximal end.

10. An apparatus as recited in claim 9, further comprising:

(a) a plurality of recesses, said recesses disposed on said plate;

(b) a boss protruding from said swivel arm, said boss structured and configured to frictionally engage said recesses upon pivotal motion of said swivel arm; and (c) spring means for biasing said arcuate member towards said proximal end of said swivel arm.

11. An apparatus as recited in claim 7, wherein said protective eyewear mounting means comprises a receptacle within said arcuate member for receiving said protective eyewear.

12. A cap, comprising:

(a) a crown portion;

(b) an arcuate member pivotally coupled to said crown portion and adjustable between a lowered position and a raised position, said arcuate member including a pair of ends;

(c) a channel, said channel extending between said ends of said arcuate member;

(d) a visor removably attached to said arcuate member; and (e) a pair of receptacles within said arcuate member, each said receptacle disposed adjacent each said end of said arcuate member; each said receptacle structured and configured to receive therein a forwardly disposed tip of an eyeglass temple.

13. An apparatus as recited in claim 12, further comprising:

(a) a plurality of posts, said posts disposed within said channel of said arcuate member;

(b) a trailing edge on said visor, said trailing edge structured and configured to engage within said channel of said arcuate member; and (c) a plurality of cutouts, said cutouts disposed on said trailing edge of said visor, said cutouts structured and configured to frictionally engage said posts within said channel.

14. An apparatus as recited in claim 13, further comprising:

(a) a plate, said plate, attached to said crown portion; and (b) a swivel arm pivotally attached to said plate, said swivel arm structured and configured to receive said arcuate member, said swivel arm including a proximal end.

15. An apparatus as recited in claim 14, further comprising:

(a) a plurality of recesses, said recesses disposed on said plate;

(b) a boss protruding from said swivel arm, said boss structured and configured to frictionally engage said recesses upon pivotal motion of said swivel arm; and (c) spring means for biasing said arcuate member towards said proximal end of said swivel arm.

* * * * *